US009830761B2

(12) United States Patent
Kaiser et al.

(10) Patent No.: US 9,830,761 B2
(45) Date of Patent: Nov. 28, 2017

(54) ELECTRONIC KEY

(71) Applicant: Continental Automotive GmbH, Hannover (DE)

(72) Inventors: Wolfgang Kaiser, Höchstädt I.F. (DE); Rudolf Renner, Nürnberg (DE); Florian Schweiger, Kehlheim (DE)

(73) Assignee: Continental Automotive GmbH (DE)

( * ) Notice: Subject to any disclaimer, the term of this patent is extended or adjusted under 35 U.S.C. 154(b) by 14 days.

(21) Appl. No.: 14/778,356

(22) PCT Filed: Mar. 19, 2014

(86) PCT No.: PCT/EP2014/055481
§ 371 (c)(1),
(2) Date: Sep. 18, 2015

(87) PCT Pub. No.: WO2014/154542
PCT Pub. Date: Oct. 2, 2014

(65) Prior Publication Data

US 2016/0071346 A1 Mar. 10, 2016

(30) Foreign Application Priority Data

Mar. 28, 2013 (DE) ..... 10 2013 205 675

(51) Int. Cl.
*E05B 19/00* (2006.01)
*G07C 9/00* (2006.01)
(Continued)

(52) U.S. Cl.
CPC ..... *G07C 9/00896* (2013.01); *E05B 19/0082* (2013.01); *G07C 9/00944* (2013.01);
(Continued)

(58) Field of Classification Search
CPC ..... G07C 9/00896; G07C 9/00944; G07C 2009/00952; E05B 19/0082; H01H 9/0235; H01H 2223/003
(Continued)

(56) References Cited

U.S. PATENT DOCUMENTS 5,568,367 A * 10/1996 Park ..... H01H 9/0235 200/314
7,142,413 B2 11/2006 Sugimoto
(Continued)

FOREIGN PATENT DOCUMENTS

DE 102006031727 1/2007
DE 102006045527 4/2008
(Continued)

OTHER PUBLICATIONS

German Examination Report for German Application No. 10 2013 205 675.3 dated Mar. 14, 2014.
(Continued)

*Primary Examiner* — Edwin Holloway, III
(74) *Attorney, Agent, or Firm* — RatnerPrestia

(57) ABSTRACT

An electronic key having the following features. The electronic key has a key housing and a switch housing in the key housing. The switch housing has an inherently rigid frame having at least one first breakout, and a flexibly deformable membrane which is arranged on the frame in order to close the at least one breakout and to forward a force having effect from the outside on the membrane in the region of the breakout to an electrical switch element arranged within the frame. An electronic key having the required amount of stiffness is thus created, in which sensitive electronic components located therein are also protected from environmental influences. If the deformable membrane is not only used for button-related functions, but also for forming an ejection
(Continued)

section for an emergency key or as a rattle protection for the emergency key, a multifunctional switch housing can thus be created simply.

11 Claims, 6 Drawing Sheets

(51) Int. Cl.
*H01H 13/06* (2006.01)
*H01H 9/02* (2006.01)

(52) U.S. Cl.
CPC . *H01H 9/0235* (2013.01); *G07C 2009/00952* (2013.01); *H01H 2223/003* (2013.01)

(58) Field of Classification Search
USPC ..... 340/5.72
See application file for complete search history.

(56) References Cited

U.S. PATENT DOCUMENTS

| | | | | |
|---|---|---|---|---|
| 7,705,258 | B2 | 4/2010 | Geldmacher | |
| 9,041,512 | B2 | 5/2015 | Nakabayashi | |
| 9,076,603 | B2 | 7/2015 | Senzaki | |
| 2009/0173613 | A1* | 7/2009 | Geldmacher | E05B 19/04 200/5 A |
| 2011/0241830 | A1* | 10/2011 | Saito | G07C 9/00944 340/5.61 |
| 2012/0111709 | A1* | 5/2012 | Senzaki | H01H 9/0235 200/5 A |
| 2013/0015048 | A1* | 1/2013 | Senzaki | H01H 9/0235 200/513 |
| 2013/0031941 | A1 | 2/2013 | Porada | |
| 2014/0043140 | A1* | 2/2014 | Nakabayashi | G07C 9/00944 340/5.72 |
| 2014/0055237 | A1* | 2/2014 | Sersch | G07C 9/00944 340/5.64 |
| 2016/0055991 | A1* | 2/2016 | Kropf | G07C 9/00944 200/5 A |

FOREIGN PATENT DOCUMENTS

| | | |
|---|---|---|
| DE | 102006048369 | 4/2008 |
| DE | 102011005038 | 9/2012 |
| EP | 1327734 | 7/2003 |
| EP | 1837831 | 9/2007 |
| EP | 2692971 | 2/2014 |
| JP | 2001182389 | 7/2001 |
| JP | 2004308388 | 11/2004 |
| JP | 2013020870 | 1/2013 |
| WO | 2006092250 | 9/2006 |
| WO | 2012132457 | 10/2012 |

OTHER PUBLICATIONS

International Search Report for International Application No. PCT/EP2014/055481 dated Aug. 27, 2014.
Japanese Office Action dated Aug. 19, 2016 for Japanese Application No. JP 2016-504575, including English translation, 8 pages.

* cited by examiner

ELECTRONIC KEY

CROSS REFERENCE TO RELATED APPLICATIONS

This application is the U.S. National Phase Application of PCT International Application No. PCT/EP2014/055481, filed Mar. 19, 2014, which claims priority to German Patent Application No. 10 2013 205 675.3, filed Mar. 28, 2013, the contents of such applications being incorporated by reference herein.

FIELD OF THE INVENTION

The present invention relates to an electronic key which, as an identification transmitter, is able to exchange encoded signals with a vehicle in order to trigger certain functions in the vehicle.

BACKGROUND OF THE INVENTION

Nowadays, there is a need for portable electronic user apparatuses, such as electronic keys or radio keys for vehicles for example, which can trigger various vehicle functions from a distance. In particular, any desired design variants with any desired button shapes should be possible, depending on customer requirements. Furthermore, efforts are increasingly being made to reduce the dimensions, in particular the overall height, of the electronic keys in order to improve the carrying comfort. However, in spite of reduced installation space requirements, the necessarily high level of rigidity of the electronic key should continue to be ensured. In addition, the electronics which are required in the electronic key are becoming ever more intricate, and therefore they have to be protected against environmental influences.

SUMMARY OF THE INVENTION

An aspect of the present invention provides an electronic key which has reduced installation space requirements together with the necessary high level of rigidity and protection against environmental influences.

Said subject matter discloses an electronic key, in particular for a vehicle, having the following features. Said electronic key has a housing, or rather a key housing. Furthermore, said electronic key has a switch housing which is accommodated in the key housing and firstly has an inherently dimensionally rigid frame with at least one aperture, and also has a flexibly deformable or elastic diaphragm which is arranged on the frame so as to close the at least one first aperture and to pass on a force which acts on the diaphragm in the region of the aperture from the outside to an electrical switching element which is arranged within the frame. Therefore, providing the switch housing with the dimensionally rigid frame increases or ensures the rigidity of the key housing and, furthermore, protection against environmental influences, such as the ingress of water, corrosion etc., is provided by the at least one first aperture being covered by the diaphragm, wherein an effect can be had in the interior of the switch housing owing to the elasticity in the region of the at least one aperture.

According to one advantageous refinement, it is possible in this case for the diaphragm and the frame to be in the form of a two-component injection-molded element, in which the diaphragm forms the soft component and the frame forms the hard component of the two-component injection-molded element. Very precise and efficient combination of the two components is achieved in this way, wherein movement in relation to the respective other component is further prevented. However, it is also possible to fasten the diaphragm to the frame by adhesive bonding, friction welding, using clips, by a laser welding method and/or by an ultrasonic welding method. This also prevents the diaphragm from slipping in relation to the frame and improves the reliability of triggering of the electrical switching element when a force acts on the diaphragm in the region of the at least one aperture.

In addition to the sealing function of the diaphragm when forming the switch housing in cooperation with the frame, the diaphragm can fulfill further structural functions, as will be explained with reference to the following advantageous refinements.

It is possible in this case for the diaphragm to form one or more first predetermined sections on the outer face of the frame, the frame bearing against an inner face of the key housing and being connected to said key housing at said first predetermined sections. Therefore, mechanical vibrations, which act on the key housing, are already absorbed by the diaphragm in the region of the first predetermined sections by virtue of the flexibly deformable or elastic diaphragm bearing against the key housing, and therefore components which are situated on the switch housing or in the switch housing are also protected against mechanical environmental influences. In this case, it is possible for one or more second apertures to be provided in the frame, the diaphragm running out of the switch housing from the inside to the outside through said second aperture or apertures in order to form the one or more first predetermined sections. The diaphragm has a further structural function in this way.

According to a further advantageous refinement, it is feasible for the electronic key to further have a mechanical emergency key, in particular in the form of a metal key bit, which is accommodated in the key housing adjacent to the switch housing or adjacent to a section of said switch housing. This means that when it is no longer possible to use the electronic key to perform a vehicle function, such as unlocking one or more vehicle doors for example, from a distance, at least access to the vehicle at a corresponding door lock of the vehicle can be made possible using the mechanical emergency key. If this mechanical emergency key is then accommodated adjacent to the switch housing (or a section of said switch housing), according to this refinement the diaphragm can form one or more second predetermined sections adjacent to the emergency key on the outer face of the frame, said second predetermined sections bearing against the emergency key so as to damp movements (such as vibrations) of said emergency key. In particular, it is possible in this case for the emergency key to be pushed against an inner wall of the key housing by means of the one or more second predetermined sections and to be prestressed against the key housing on account of the elasticity of the diaphragm. In this way, movements of the emergency key are prevented, so that "rattle protection" is therefore provided as a result. It is again possible in this case too for the frame to have one or more third apertures through which the diaphragm passes from the inside to the outside in order to form the one or more second predetermined sections. Consequently, the diaphragm has a further structural function.

According to a further advantageous refinement, the key housing is formed in such a way that it has a removable cover which is arranged adjacent to the switch housing. In this case, the cover can be formed as part of the key housing. Furthermore, a holding device for holding the cover on the key housing or for holding said cover in a prespecified position is provided, said holding device also allowing this holding function to be released. The diaphragm advantageously now forms one or more third predetermined sections adjacent to the cover on the outer face of the frame of the switch housing, said third predetermined sections bearing against the cover so as to push said cover out of its position after the holding device releases the cover. This means that, in the state in which the cover is held on the key housing by the holding device (in the predetermined position), the one or more third predetermined sections of the diaphragm are pushed against the cover with a predetermined force. In the process, the diaphragm is elastically deformed in the region of these third predetermined sections and builds up a spring force which counteracts the deformation. If the cover is now no longer held in the released state by the holding device, the spring energy of the third predetermined sections which was previously built up during compression is released and the cover is pushed out of its position. In this way, the diaphragm fulfills a further structural function, and it is possible, for example, to save an additional spring which would otherwise usually be used to automatically detach a cover. In addition, the expenditure on equipment is minimized owing to the use of the diaphragm as a spring, and the installation space can also be reduced as a result.

According to an advantageous refinement of the holding device, said holding device has a latching lug which can be accommodated in or moved into a corresponding latching recess in the cover in order to hold or to fix the cover. The latching lug can be moved out of the latching recess in order to release the cover again. Instead of a latching recess on the cover, it is also feasible to form a latching projection on the cover, said latching projection interacting with the latching lug in such a way that it pushes against the latching lug of the holding device in the event of a prestress by the one or more third sections of the diaphragm, so that the cover is held in the held position by virtue of the latching projection of the cover interacting with the latching lug.

According to a further advantageous refinement, an emergency key or a mechanical key bit is fixedly connected to the cover, and therefore the emergency key can be easily removed from its compartment in the electronic key housing in a simple manner by automatically detaching the cover after it is released by the holding device.

According to a further advantageous refinement, the electronic key has a printed circuit board with the electrical switching element which is fitted to the frame within the switch housing. In particular, the printed circuit board is fitted to the frame in such a way that the electrical switching element is situated beneath the at least one first aperture, in order to be operated by the elastic diaphragm. Therefore, the frame within the switch housing not only has the function of mounting the diaphragm but also a holding function for further components, in particular electronic components, which are to be protected against environmental influences within the frame or within the switch housing.

In particular, it is possible in this case for the diaphragm to form one or more fourth predetermined sections on the inner face of the frame (that is to say within the switch housing), the printed circuit board bearing against said fourth predetermined sections. In this way, it is again possible to damp vibrations which act on the switch housing via the key housing from the outside, once again at the fourth predetermined sections, so that said mechanical vibrations can be reduced to a minimum and sensitive electrical and/or electronic components are protected as well as possible. Consequently, the diaphragm has a further structural function.

According to a further refinement of the switch housing, said switch housing has a cap which has projections in order to push the printed circuit board against the one or more fourth predetermined sections of the diaphragm by means of the projections in the state in which the cap is fitted on the switch housing. In this way, the printed circuit board can be effectively fixed within the switch housing and, as mentioned above, protected against external mechanical and other influences, such as the ingress of water etc.

Finally, the diaphragm according to a further advantageous refinement can have at least one fifth predetermined section which runs toward the outside from the interior of the switch housing, wherein the at least one fifth section has a coupling-in section in the interior of the switch housing and an output section outside the switch housing, wherein a light source (such as an LED) is arranged adjacent to the coupling-in section in the interior of the switch housing, in particular on the printed circuit board, in order to conduct light to the output section through the diaphragm as a light guide. Therefore, the diaphragm, as a light guide, can conduct light to the output section, from where it finally exits. In this way, the diaphragm can also perform the function of a light guide, in addition to various sealing and holding functions, and therefore a separate light guide component can be saved.

BRIEF DESCRIPTION OF THE DRAWINGS

Exemplary embodiments of the present invention will now be explained in greater detail below with reference to the appended drawings, in which:

FIGS. 1A-1B) being mounted on said switch housing;

DETAILED DESCRIPTION OF THE PREFERRED EMBODIMENTS

An electronic key for a vehicle is now intended to be described in the text which follows. In this case, an electronic key for a vehicle generally has an electronics part which is fed by an energy store, such as a battery or a rechargeable battery. In addition, an electronic key of this kind has, for communicating with a controller of the vehicle, a transceiver device for exchanging signals, in particular radio signals. Therefore, a code which is stored in an electronic memory of the key is sent to the vehicle in a unidirectional manner in the case of an active access system, or exchanged between the electronic key and the vehicle in a bidirectional interchanging code method as part of a passive access system. After each positive authentication, the control unit in the vehicle unlocks the locks, and therefore the vehicle user can open the doors. This authentication process can be started either by pressing a button (as part of an active access system) on the electronic key or, in the case of vehicles with a passive access system, is triggered by the vehicle if said vehicle detects by means of sensors that a user or an electronic key is approaching. To this end, the vehicle user carries an electronic key with a keypad and possibly with an integrated mechanical emergency key.

As already mentioned, an electronic key can therefore firstly comprise the function of unlocking (and also locking) the vehicle doors, but it can also be used as a remote control means for controlling other vehicle functions, such as for controlling an alarm system and for switching on an auxiliary heater etc. In order to control these functions remotely, the electronic key comprises one or more buttons which can be operated by a user in order to trigger the respective functions.

An embodiment of an electronic key according to the invention is now intended to be described below, said embodiment, in spite of a low installation space, being provided with a necessarily high degree of rigidity of the entire key apparatus and also protection of sensitive electronics components against environmental influences.

Figure 1A:
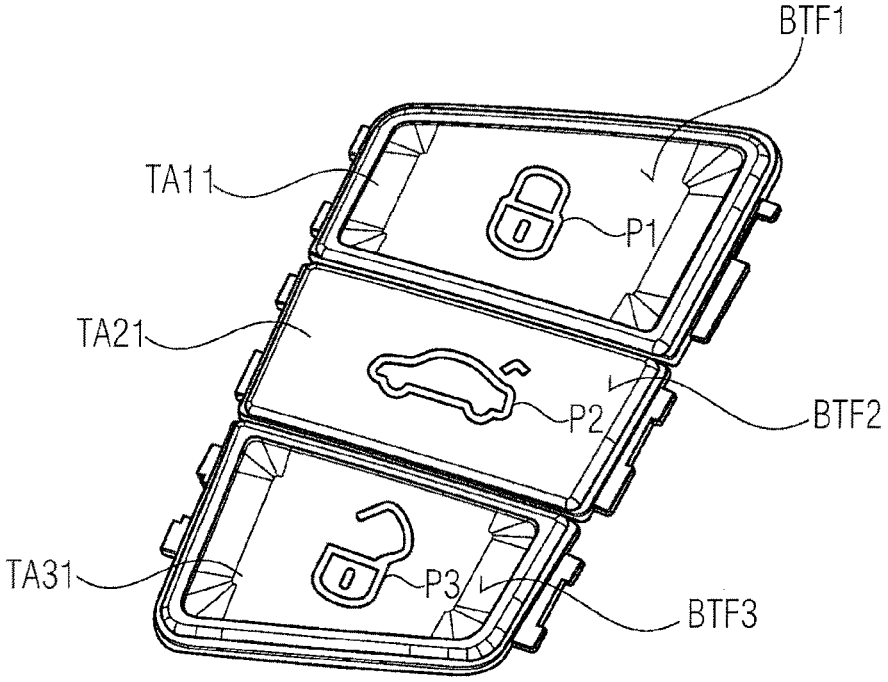
FIGS. 1A-1B show a schematic illustration of the buttons or button caps of the keypad of an electronic key according to one embodiment of the invention.
Figure 1B:
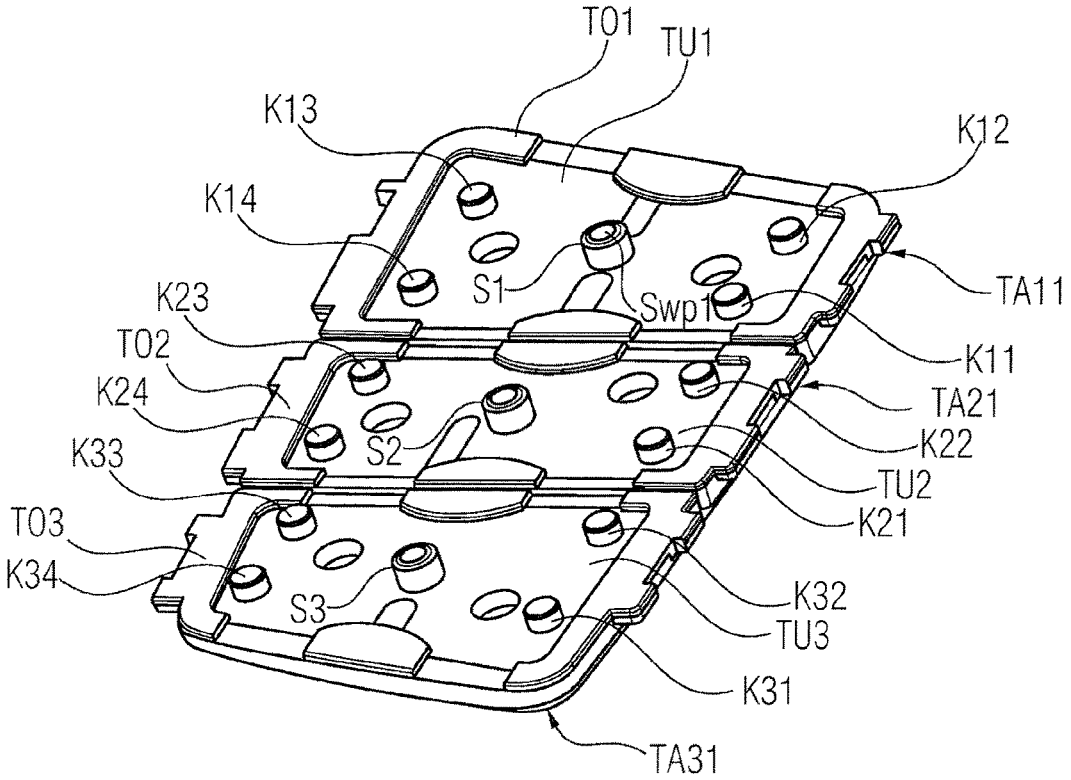

Reference will first be made to FIGS. 1A-1B which show a schematic view of the buttons of a keypad or an operator control panel of the electronic key. In this case, a front view of the buttons is illustrated in FIG. 1A, whereas a rear view of the buttons is shown in FIG. 1B.

The keypad according to the illustration of FIG. 1A in this case comprises three buttons TA11, TA21, TA31 with corresponding function pictograms P1 (corresponding to a door locking function), P2 (corresponding to a trunk lid opening function) and P3 (corresponding to a door unlocking function), so that a user knows which function is triggered when he presses a particular button. To be precise, each of the buttons TA11, TA21, TA31 has a respective top button section TO1, TO2, TO3 on which the pictogram is provided and which provides the respective operating surface for operation by a user, and has a lower button section TU1, TU2, TU3 which, in the assembled state of the electronic key, faces the housing interior and has corresponding force or switching domes for mounting and operating an electrical switching element, as is shown in FIG. 1B. The respective upper and lower button sections are advantageously inherently dimensionally rigid and form a two-component injection-molded element overall.

As will be explained in even greater detail later, for example with reference to FIGS. 3A-3B, the buttons are mounted or supported by corresponding elastic or flexibly deformable diaphragms, such as diaphragm M12 in FIGS. 3A-3B. To this end, the respective buttons TA11, TA21, TA31 or the lower button sections TU1, TU2, TU3 thereof have button-side projections or force domes (force tappets). In this case, said force domes are arranged beneath a respective operating surface BTF1, BTF2 and BTF3 of a respective button TA11, TA21 and TA31 in the state in which the buttons and the diaphragms are assembled. In particular, the force domes are arranged beneath or in the vicinity of the edge regions or, in the case of corner operating surfaces, in the region of the corners of the operating surfaces of the buttons, so that they span as large an area as possible, and therefore, even in the event of off-center operation of a button, the force of the user can be transmitted as far as possible to all of the domes and therefore a predefined force characteristic curve or haptic characteristic curve can be achieved. As shown in FIG. 1B, the respective force domes are arranged substantially in the corner sections of the respective diaphragm and accordingly also beneath the corner sections of the operating surfaces of the buttons TA11, TA21 and TA31, which surfaces are situated above them.

In this case, the force domes are not positioned above an electrical switching element or not positioned in a switching axis of said electrical switching element.

In this case, the first button TA11 has the force domes K11, K12, K13 and K14, the second button TA21 has the force domes K21, K22, K23, K24, while the third button TA31 has the force domes K31, K32, K33 and K34. In addition to the force domes which are in the form of projections, the respective buttons further have a projection which serves as a switching tappet, that is to say which passes on a button operation, to be precise a movement of the button in the direction of the tappet, to an electrical switching element which is situated beneath it. In order to reliably trigger a respective electrical switching belt, the respective switching tappets S1, S2, S3 are advantageously arranged in the geometric center of the area which is spanned by the force domes. In particular, a geometric center of an area of this kind is also congruent to the geometric center of the operating surface which is situated on the opposite side of a respective button. By way of example, the switching tappet should coincide with the geometric center SWP1 of the area which is spanned by force domes K11, K12, K13 and K14.

Figure 2:
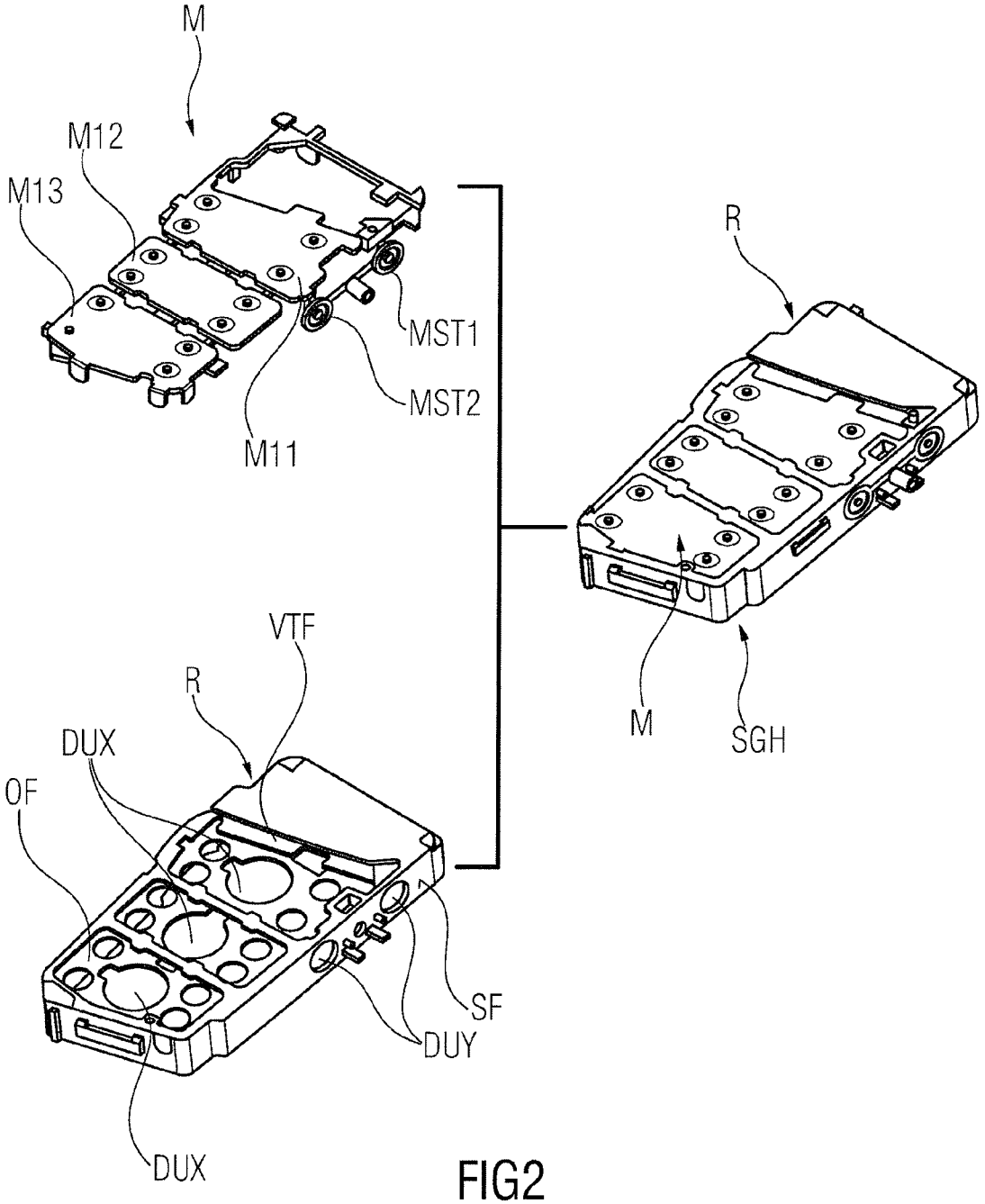
FIG. 2 shows an exploded illustration of the important components of a switch housing of the electronic key according to one embodiment of the invention, the buttons (cf.

Reference will now be made to FIG. 2 which shows an exploded illustration of the important components of a switch housing of the electronic key. Looking at the left-hand part of FIG. 2 to begin with, a diaphragm M can be seen in the upper section, said diaphragm being formed from an elastic material and therefore being flexibly deformable. An inherently dimensionally rigid frame R which has a large number of apertures which are covered or closed by sections of the diaphragm in the state in which the diaphragm M and the frame R are assembled are shown in the lower section on the left-hand side of FIG. 2. In particular, the frame R has apertures DUX on the top face and apertures DUY on a side face which is tilted through 90° in relation to said top face, electrical switching elements, such as microswitches, which are arranged in the frame and can be operated by means of moving or operating a diaphragm section which is situated above them being provided behind said apertures. In order to close the regions of the frame which are provided for operation of a button, the diaphragm M has a plurality of diaphragm sections or partial diaphragms, wherein partial diaphragms M11, M12 and M13 are provided for covering the apertures which are situated in the top face for the button functions, in particular the apertures DUX, and partial diaphragms MST1 and MST2 are provided for closing the apertures DUY for button functions in the side face SF.

On the top face or surface OF, the frame R has a recessed portion VTF in which the diaphragm M, in particular the partial diaphragms M11, M12 and M13, is/are accommodated. The assembled state of the two components, the diaphragm M and the frame R, is shown on the right-hand side of FIG. 2, wherein said two components form a switch housing S which is sealed off at the top. As is clear from FIG. 2, the diaphragm M therefore has a first structural function, which involves sealing off the switch housing, in which, as will be explained in even greater detail below, sensitive electrical or electronic components can be situated.

Figure 3A:
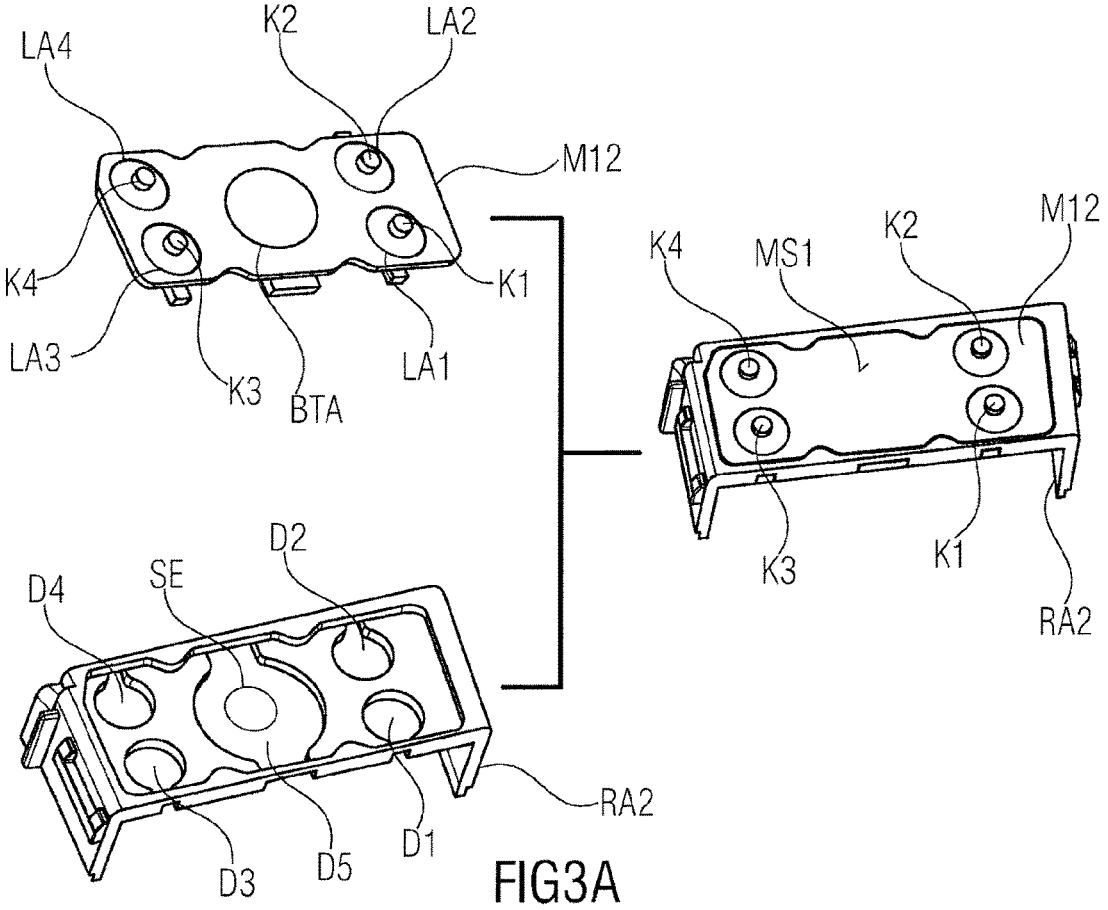
FIGS. 3A-3B show an exploded illustration of the important components of a portion of the switch housing of the electronic key according to FIG. 2.
Figure 3B:
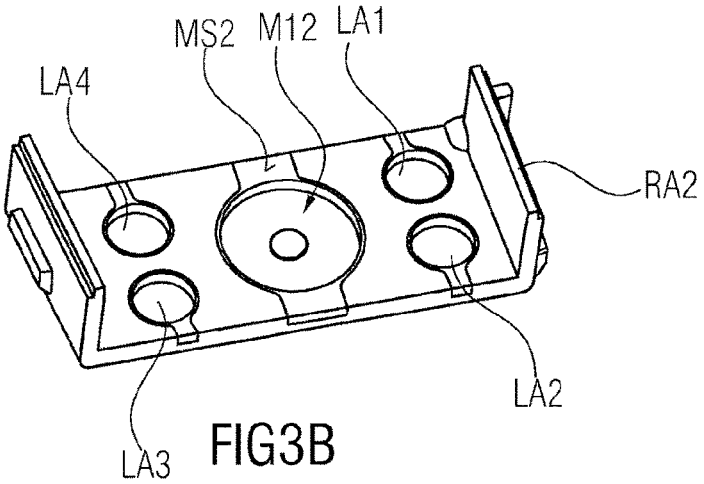

Reference will now be made to FIGS. 3A and 3B in which a further structural function of the diaphragm on the switch housing is intended to be explained with reference to a further exploded illustration of the important components of the switch housing, in particular of the region of the second button, in which the diaphragm M12 is functionally formed. Looking at FIG. 3A to begin with, the diaphragm M12 which can be assembled with a frame RA2 in order to realize a keypad of the electronic key and which forms a part in the region of the second button of the frame R is shown on the left-hand side of said figure. As already mentioned, the diaphragm and the frame can be in the form of a two-component injection-molded element in which the diaphragm forms the soft component and the frame forms the hard component of the two-component injection-molded element. The diaphragm M12 has, on a first side MS1, four force domes K1, K2, K3 and K4 on which a touch element (illustrated in FIG. 1) can be mounted or supported. The respective force domes are situated in sections LA1, LA2, LA3 and LA4 of the diaphragm M12, said sections also being called bearing sections. An operating section BTA is shown in the center of the diaphragm, an electrical switching element SE being located beneath said operating section in the assembled state of the key (as is shown using dashed lines). It should be noted that an electrical switching element is situated only beneath an operating section BTA (this also applies for the other buttons) but not below the bearing sections. It should further be noted that (although not shown in FIG. 3A) a raised portion or a projection in the form of a diaphragm-side upper switching tappet or switching dome which interacts with one of the button-side switching tappets S1, S2 and, respectively, S3 can likewise be formed on the first side MS1 in the region of the operating section according to one possible refinement.

Looking now at the frame RA2, it is clear that, in a state in which the frame RA2 and the diaphragm M12 are assembled, apertures D1, D2, D3 and D4 are situated beneath the respective bearing sections, and that a further aperture D5 is situated beneath the operating section BTA.

The assembled state of the two components is shown on the right-hand side of the figure, wherein the first side MS1 of the diaphragm M12 is averted from the frame RA2, the projections or the force domes K1, K2, K3 and K4 projecting away from said first side, in the assembled state.

FIG. 3B now shows the state in which the diaphragm M12 and the frame RA2 are assembled from the rear and from the bottom, wherein it is clear from said figure that the respective bearing sections LA1, LA2, LA3 and LA4 are adjacent to the apertures D1, D2, D3 and D4 of the frame RA2, and the operating section BTA is adjacent to the further aperture D5. The diaphragm M12 is supported by the frame RA2 on a second side MS2 of the diaphragm M12 which is opposite the first side. An operating projection BTV can be seen in the center of the rear of the operating section BTA (or below the diaphragm-side switching tappet), it being possible to move said operating projection in the direction of a switching element which is situated beneath it when the button which is situated above it is operated, in order to trigger the switching element. The position of the center axis of the operating projection BTV and of the center axis of a switching element, such as a microswitch, which is situated beneath it preferably coincide.

If a button which is mounted on the diaphragm M12, to be precise on the force domes K1, K2, K3 and K4, is operated, the respective force domes or the bearing sections which are situated around them are moved through that aperture in the frame which is respectively situated beneath said bearing sections when the button is operated, wherein a respective bearing section of the diaphragm is deformed in the process. This deformation generates a counterforce which depends on the size and/or the shape of the aperture and on the diaphragm material or the diaphragm thickness. In other words, the diaphragm, of which the shape is changed in the region of the at least one bearing section by means of the tappet through the at least one first aperture, provides a spring force which acts in the direction of the button and consequently on the finger of a user, which finger is operating the button. If, for example, the size of the aperture or the diameter of the aperture is small in comparison to the tappet diameter, only relatively little material of the diaphragm is moved through the first aperture when the button is operated, wherein this little material is deformed to a great extent and a high spring force or return force is achieved as a result. If, in contrast, the bearing section is large in comparison to the tappet or force dome, a relatively large amount of diaphragm material is moved through the aperture in comparison to the first case just described, and therefore this material is deformed only to a slight extent and therefore the return force also remains low. Therefore, the diaphragm, in particular in the region of the bearing sections, serves to provide a spring force or return force when a button is operated, and therefore has a further structural function.

Figure 4:
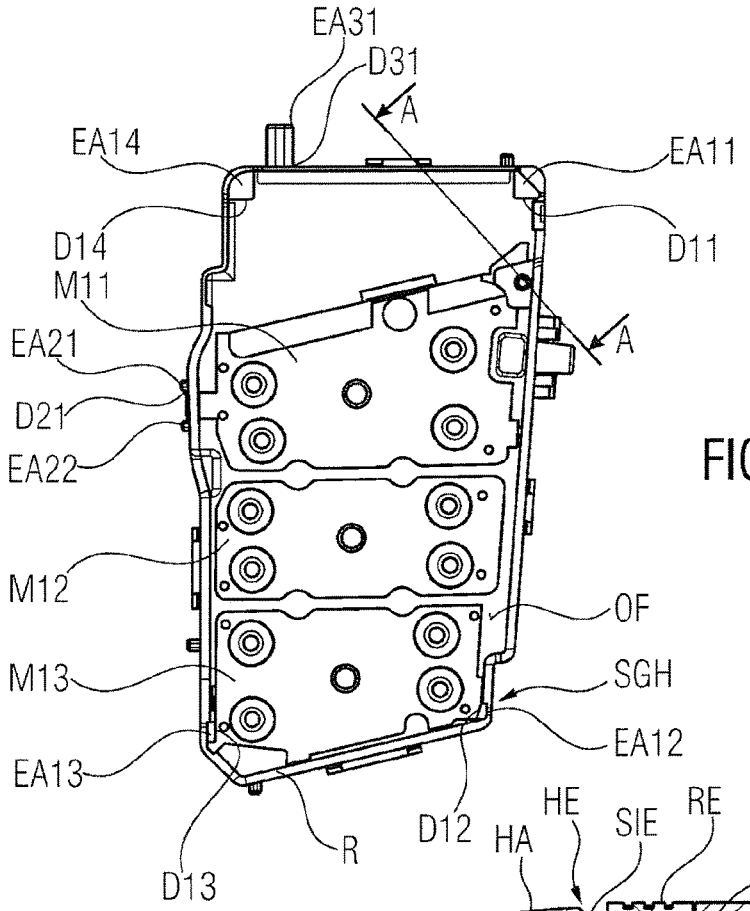
FIG. 4 shows a plan view of the switch housing according to FIG. 2 from above.

Reference will now be made to FIG. 4 which shows a schematic illustration of the switch housing SGH of FIG. 2 looking at the top face or surface OF. It is clear from this figure that the surface OF is formed from parts of the frame R and partial diaphragms M11, M12, M13 of the diaphragm M which are formed between said parts. In addition to these button-related functions of the diaphragm which have already been described in preceding figures, further structural functions of the diaphragm M are to be described with reference to FIG. 4. As was already shown in the left-hand part of FIG. 2, the frame R has a large number of apertures through which sections of the diaphragm run from the inside to the outside with respect to the frame and form specific functional sections on the outer face of the frame. Therefore, the frame has apertures D11, D12, D13 and D14 through which first sections EA11, EA12, EA13 and EA14 run, from the inside to the outside, as far as the top face OF of the frame.

Figure 5:
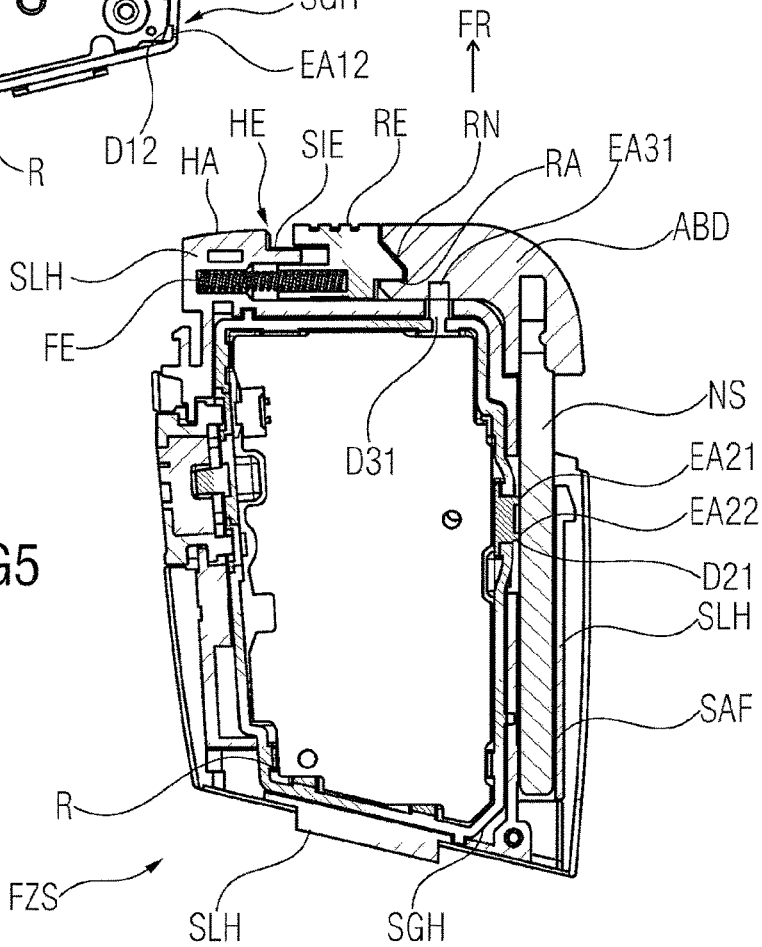
FIG. 5 shows a cross-sectional illustration of a key housing into which the switch housing is integrated, according to one embodiment of the invention.

As is also further shown in FIG. 5, the switch housing SGH is accommodated within the housing of the key, also called the key housing SLH for short. According to one advantageous refinement, the switch housing SGH is, in particular, mounted or held on the first sections EA11, EA12, EA13 and EA14, shown in FIG. 4, in this case. This has the advantage that the switch housing SGH is fixed within the key housing and cannot move within the key housing, as a result of which "rattle protection" is provided. The fact that the mounting of the switch housing SGH is formed by means of elastic or shapeable sections EA11 to EA14 of the diaphragm has the further advantage that tolerance compensation of the switch housing SGH in relation to the key housing is provided. In addition, mechanical vibrations which act on the key housing can already be at least partially absorbed at the elastic first sections EA11 to EA14. In addition to the first sections, shown in FIG. 4, it is also feasible to provide yet further first sections for mounting the switch housing SGH in relation to the key housing in order to further improve said advantages.

As is explained in even greater detail in FIG. 5, a further aperture D21 is provided on the frame R, part of the diaphragm running through said further aperture from the inside to the outside in order to form second sections EA21 and EA22. These second sections EA21 and EA22 can be brought into contact with an emergency key which is shown in FIG. 5.

Furthermore, the frame R has an aperture D31 through which part of the diaphragm passes in order to form a third section EA31. This third section can be brought into contact with a cover of the key housing, wherein, in the closed state of the cover, said third section is deformed by the contact pressure and builds up a corresponding spring force or counterforce.

Reference will now be made to FIG. 5 which shows a cross section through a vehicle key FZS. In this case, the vehicle key FZS has a key housing SLH. The switch housing SGH is provided within the key housing SLH. In this case, as has already been mentioned above in the figures, the switch housing SGH comprises the frame R as a supporting element which has a plurality of apertures through which parts of the diaphragm run as elastic components in order to provide specific functional sections on the outer face of the frame, the intention being for some of said functional sections to now be explained in greater detail.

Looking now at the right-hand section of FIG. 5, it is clear that an emergency key NS in the form of a metal key bit is at least partially accommodated in a receptacle SAF of the key housing SLH. In order to allow the emergency key NS to be easily pushed into and withdrawn from the receptacle SAF, a certain amount of play is provided in respect of the emergency key dimensions in relation to the dimensions of the receptacle SAF. However, on account of this play, it is possible for the emergency key to move on account of vibrations and in the process to strike the inner wall of the housing, this leading to "rattling". In order to remedy this, special precautions are taken in the part of the switch housing SGH which is arranged adjacent to the emergency key NS. As has already been mentioned with respect to FIG. 4, said part of the switch housing which is adjacent to the emergency key has one or more apertures through which part of the elastic diaphragm can be forced in order to form the abovementioned second sections EA21 and EA22 on the outer face of the frame R. In this case, these second sections EA21 and EA22 are brought into contact with the emergency key NS in order to absorb movements of the emergency key NS and therefore to prevent or to minimize rattling of the emergency key. In particular, it is possible for the second sections EA21 and EA22 to push the emergency key against an inner wall of the emergency key receptacle SAF in this case. As a result of the second sections being in the form of elastic elements, it is also easily possible to remove the emergency key NS from the receptacle SAF (upward in the plane of the drawing) again. In this way, the diaphragm fulfills a further structural function, specifically that of providing rattle protection for an emergency key.

As is clear from the upper section of FIG. 5, the key housing SLH has a holding device HE for holding a cover ABD. The cover, which can be in the form of part of the key housing SLH in this case, is fixedly connected to the emergency key according to the embodiment of the invention. As is clear from the top-left of the figure, the holding device HE has a stationary holding section HA which comprises a rail SIE along which a latching element RE can move (from left to right, or vice versa, in the plane of the drawing). In this case, the latching element is prestressed by means of a spring FE in the direction toward the right in the plane of the drawing, to be precise in the direction of a latching lug RN of the cover ABD. As shown in FIG. 5, the cover ABD is held in a predetermined position on the key housing SLH when the latching lug RN engages into the corresponding latching recess RA since, on account of the engagement of the latching lug into the latching recess, movement of the cover ABD upward and, on account of the connection to the emergency key, movement to the right in the plane of the drawing are not possible.

Reference will now be made to the third section EA31 of the diaphragm which has already been mentioned in FIG. 4 and which runs through the aperture D31 and exits from said aperture adjacent to the cover ABD. If the cover ABD is fitted onto the key housing SLH from top to bottom in the plane of the drawing (wherein the emergency key NS is inserted into the receptacle SAF), the elastically deformable third section EA31 is compressed and generates a counterforce FR from bottom to top in the plane of the drawing in the process. This means that, in the held state of the cover ABD, as is shown in FIG. 5 (in which the latching lug is accommodated in the latching recess RA), the cover or the lower part of the latching recess is always prestressed against the latching lug RN by the third section EA31.

If the latching element RE is now pushed by way of the grooved top face from right to left in the plane of the drawing by the finger of a user (against the force of the spring FE), the latching lug RN is pushed out of the latching recess until finally the latching lug and the latching recess no longer interact. In this position of the latching element, the cover ABD is then released and, on account of the pretensioning force FR, is pushed away from the key housing SLH upward in the plane of the drawing together with the emergency key NS by the third section EA31. The cover together with the emergency key NS can now be easily grasped by a user and therefore the emergency key NS can be retrieved from its receptacle SAF in order to mechanically open a vehicle for example. Therefore, the diaphragm fulfills a further structural function, specifically an ejector function for an emergency key or automatic lifting of a cover ABD, and therefore a further additional component, such as a spring, can be saved.

Figure 6A:
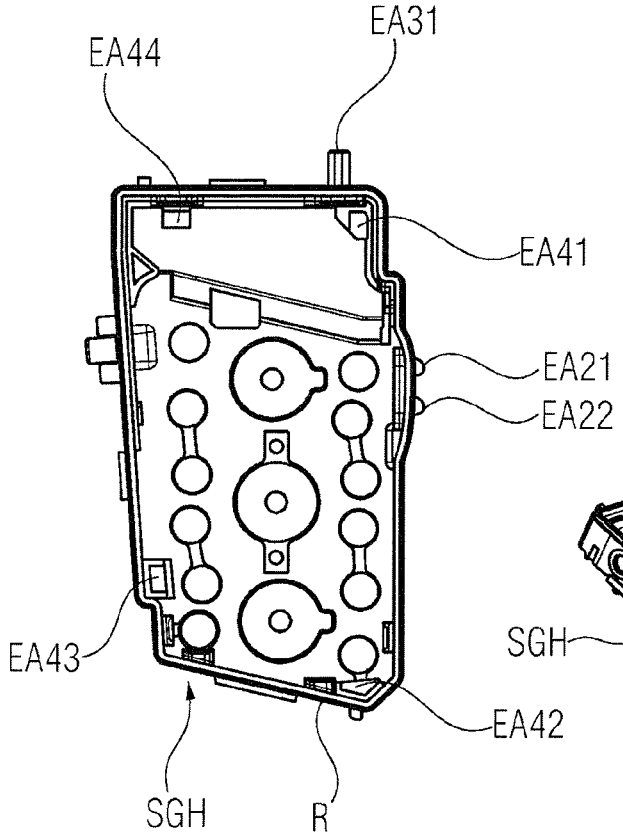
FIGS. 6A-6C show an illustration of a detail of the switch housing and, respectively, of the components which are provided in said switch housing.
Figure 6B:
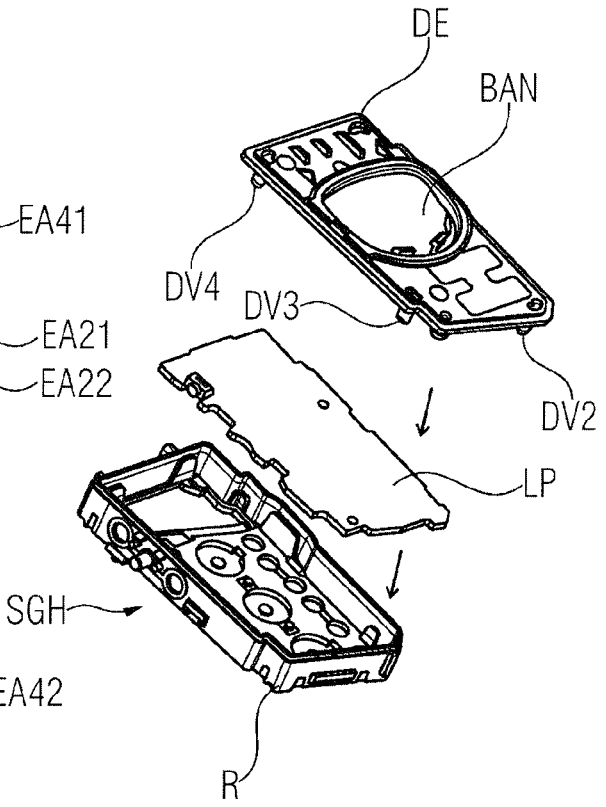
Figure 6C:
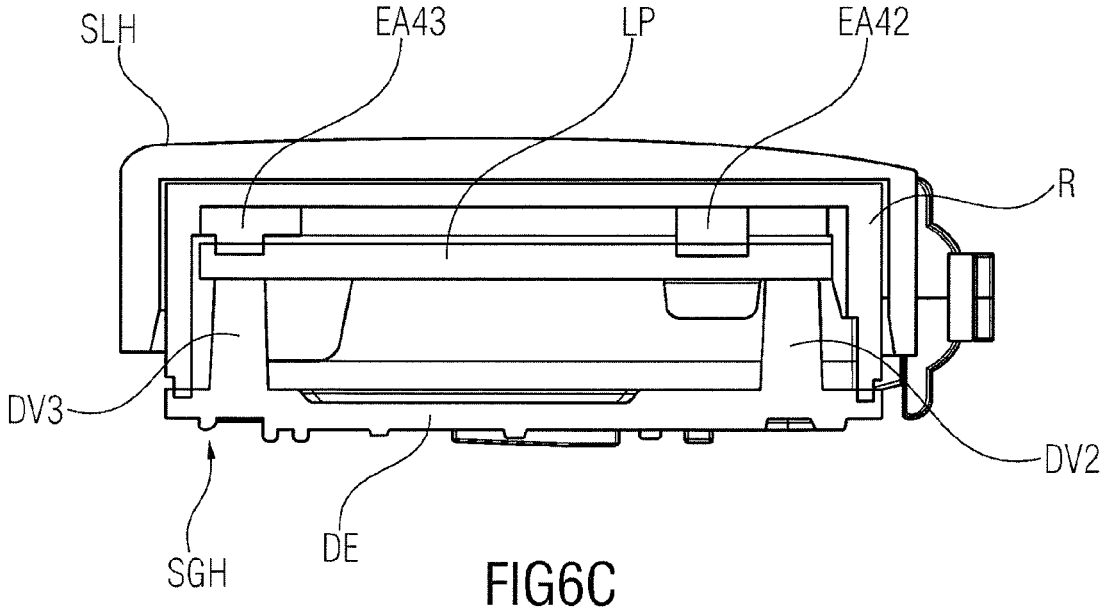

Reference will now be made to FIGS. 6A-6C in which the interior of the switch housing is now intended to be explained in greater detail.

Looking now at FIG. 6A, said figure shows a rear view of the switch housing SGH, that is to say a view of said switch housing in respect of FIG. 4 which is rotated through 180° about an axis which is situated in the plane of the drawing. In addition to the second and third sections EA21 and EA22 and, respectively, EA31 which have already been described above, fourth sections EA41, EA42, EA43 and EA44 are formed by the diaphragm in the interior of the frame R and, respectively, of the switch housing SGH, a printed circuit board LP, on which the electrical switching element and possibly further electrical or electronic components can be fitted, being mounted on said fourth sections. In this case, it is clear from the exploded illustration of FIG. 6B that a printed circuit board LP can be inserted into the interior of the frame R or of the switch housing SGH in order to be mounted on the fourth sections EA41 to EA44. A cap element DE is then fitted on said printed circuit board, said cap element having four projections, from amongst which the projections DV2, DV3, DV4 are shown in the figure. In this case, the cap element DE also has a recess BAN in the center, a battery for example being provided in said recess as an energy store in the electronic key.

FIG. 6C now shows the assembled state of the switch housing SGH according to FIG. 6B, wherein it is clear from said figure that the printed circuit board LP is held firstly from the top by the fourth sections of the diaphragm (formed by the fourth sections EA42 and EA43 in the figure) and from below by the projections of the cap element DE (by the projections DV2 and DV3 in the figure). In this case, the fourth sections EA42 and EA43 are, in particular, deformed when the switch housing SGH is assembled and push the printed circuit board LP against the projections DV2 and DV3 of the cap element DE. Since the fourth sections EA42 and EA43 are deformable, a printed circuit board support with tolerance compensation is also provided by said sections. In addition, said sections are able to absorb vibrations which are transmitted to the switch housing via the key housing, and therefore provide further protection against environmental influences from the outside. Therefore, the diaphragm has taken on a further structural function in which it ensures protection and also tolerance compensation for the printed circuit board LP.

Figure 7:
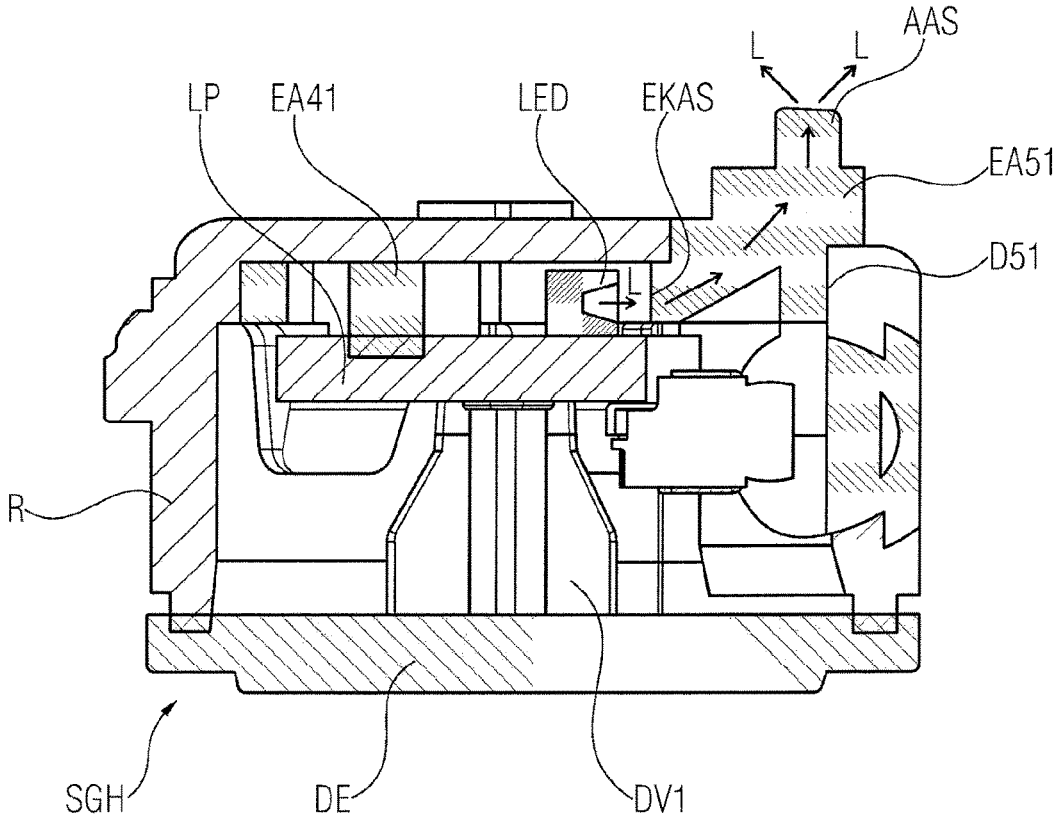
FIG. 7 shows a cross-sectional illustration through the switch housing in a region in which the diaphragm of the switch housing is used as a light guide.

Reference will finally be made to FIG. 7 which shows a sectional illustration of the section A-A shown in FIG. 4. This section shows the switch housing SGH in which the frame R is covered at the bottom face by the cap element, wherein the printed circuit board LP is held by a fourth section EA41 of the diaphragm at the top face and by a projection DV1 of the cap element from the bottom face. A light source LED, which can be in the form of an LED ("light emitting diode") in particular, is situated on the printed circuit board LP. The special feature of the slice which is shown in FIG. 7 is a section of the diaphragm which runs through an aperture D51 in the frame R. In this case, this fifth section EA51 of the diaphragm has a coupling-in section EKAS for light in the interior of the switch housing, said coupling-in section being arranged adjacent to the light source LED, wherein light L is conducted through the fifth section EA51 of the diaphragm to an output section AAS where it finally exits again. In this way, the diaphragm is additionally used as a light guide in the region of the fifth section EA51 and as a result fulfills a further structural function which allows additional components, such as a special light guide, to be saved.

Therefore, the explanations of the figures describe a switch housing which performs a large number of structural functions within the electronic key. In particular, the flexibly deformable or elastic diaphragm can be used in a variety of ways and this use provides a saving on additional parts. Furthermore, in addition to the reduction in parts, the versatile use of the diaphragm also allows the installation space which the additional parts would otherwise require to be reduced. Finally, as already mentioned in the introductory part, closing of the apertures which are provided in the frame by the diaphragm ensures protection against environmental influences, such as the ingress of water, and absorption of vibrations is made possible by virtue of mounting various components within the key housing by supporting the diaphragm. In particular, the switch housing SGH can be produced in a simple manner and perform the abovementioned numerous structural functions owing to a two-component injection-molding process for forming the frame (as a main component) and the associated diaphragm (as the soft component).

The invention claimed is:

1. An electronic key, for a vehicle, comprising:

a key housing;

at least one button separate from and movably coupled to the key housing; and a switch housing which is provided in the key housing and comprises:

a rigid frame having at least one first aperture, and also a flexibly deformable diaphragm which is arranged on the frame so as to close the at least one first aperture and to pass on a force which acts on the diaphragm in the region of the aperture from the outside to an electrical switching element which is arranged within the frame, wherein the diaphragm forms one or more first predetermined sections on an outer face of the frame, the frame bearing against an inner face of the key housing with the diaphragm between the frame and the inner face of the key housing at each of the one or more first predetermined sections.

2. The electronic key as claimed in claim 1, wherein the diaphragm and the frame are a two-component injection-molded element, in which the diaphragm forms a soft component and the frame forms a hard component of the two-component injection-molded element.

3. An electronic key, for a vehicle, comprising:

a key housing;

a switch housing which is provided in the key housing and comprises:

a rigid frame having at least one first aperture, a flexibly deformable diaphragm which is arranged on the frame so as to close the at least one first aperture and to pass on a force which acts on the diaphragm in the region of the aperture from the outside to an electrical switching element which is arranged within the frame, wherein the diaphragm forms one or more first predetermined sections on an outer face of the frame, the frame bearing against an inner face of the key housing at a first predetermined section, and a mechanical emergency key which is accommodated in the key housing at least partially adjacent to the switch housing, wherein the diaphragm forms one or more second predetermined sections adjacent to the emergency key on the outer face of the frame, said second predetermined sections bearing against the emergency key so as to damp movements of said emergency key.

4. The electronic key as claimed in claim 3, wherein the key housing further has:

a removable cover which is arranged at least partially adjacent to the switch housing;

a holding device for holding and releasing the cover;

wherein the diaphragm forms one or more third predetermined sections adjacent to the cover on the outer face of the frame, said third predetermined sections bearing against the cover so as to push said cover out of its position when the holding device releases the cover.

5. The electronic key as claimed in claim 4, wherein the holding device has a latching lug which can be accommodated in a corresponding latching recess in the cover in order to hold the cover and can be moved out of the latching recess in order to release the cover.

6. The electronic key as claimed in claim 4, wherein an emergency key is fixedly connected to the cover.

7. The electronic key as claimed in claim 1, further comprising a printed circuit board with the electrical switching element, which printed circuit board is fitted to the frame within the switch housing.

8. The electronic key as claimed in claim 7, wherein the diaphragm forms one or more fourth predetermined sections on the inner face of the frame and the printed circuit board bears against said fourth predetermined sections.

9. The electronic key as claimed in claim 8, wherein the switch housing has a cap which has projections in order to push the printed circuit board against the one or more fourth predetermined sections by the projections in the state in which the cap is fitted on the switch housing.

10. The electronic key as claimed in claim 1, wherein the diaphragm has at least one fifth predetermined section which runs toward the outside in the interior of the switch housing, wherein the at least one fifth section has a coupling-in section in the interior of the switch housing and an output section outside the switch housing, and wherein a light source is arranged adjacent to the coupling-in section in the interior of the switch housing in order to conduct light to the output section through the diaphragm as a light guide.

11. The electronic key as claimed in claim 5, wherein an emergency key is fixedly connected to the cover.

* * * * *